US005709349A

United States Patent [19]

De Chevron Villette et al.

[11] Patent Number: 5,709,349

[45] Date of Patent: Jan. 20, 1998

[54] MOTORIZED ROLLER DEVICE EQUIPPED WITH ADJUSTABLE AUTOMATIC STOP

[75] Inventors: Jean Jacques Marie De Chevron Villette, Annecy le Vieux; Jean-Michel Perache, Passy; Eric Lagarde, Sallanches, all of France

[73] Assignee: Somfy, France

[21] Appl. No.: 651,346

[22] Filed: May 22, 1996

[30] Foreign Application Priority Data

Jun. 14, 1995 [FR] France ..... 95 07084

[51] Int. Cl.[6] ..... B65H 75/34; E06B 9/88

[52] U.S. Cl. ..... 242/390.1; 242/390.2; 242/390.8; 160/293.1; 160/309

[58] Field of Search ..... 242/390.1, 390.2, 242/390.8, 390.9; 160/293.1, 309, 310, 311

[56] References Cited

U.S. PATENT DOCUMENTS

| | | | |
|---|---|---|---|
| 4,372,367 | 2/1983 | Baldanello | 242/390.1 |
| 4,651,940 | 3/1987 | Wakamura | 242/390.9 |
| 5,044,417 | 9/1991 | Bresson | 160/310 |

FOREIGN PATENT DOCUMENTS

| | | | |
|---|---|---|---|
| 1487414 | 7/1967 | France . | |
| 2076529 | 10/1971 | France . | |
| 2278904 | 2/1976 | France | 160/293.1 |
| 28 49 512 | 6/1979 | Germany . | |
| 3703417 | 8/1988 | Germany . | |
| 365969 | 11/1962 | Switzerland . | |

OTHER PUBLICATIONS

French Search Report, Mar. 1996.

*Primary Examiner*—John M. Jillions

*Attorney, Agent, or Firm*—Laff, Whitesel, Conte & Saret, Ltd.

[57] ABSTRACT

A device for the roll-up of blinds or the like that has a tubular motor mounted in a roller tube. An automatic stop and a detector for detecting that the motor is blocked, causing the motor to be stopped. The automatic stop has a screw carrying a traveling nut restrained against rotation in a tubular housing. The motor is stopped by detecting blockage of the motor through the traveling nut or the end of a blind or the like coming against a stop. Adjustment is carried out by manually rotating the housing via the housing end cheek.

7 Claims, 2 Drawing Sheets

MOTORIZED ROLLER DEVICE EQUIPPED WITH ADJUSTABLE AUTOMATIC STOP

FIELD OF THE INVENTION

The subject of the present invention is a device for rolling up a roll-up element such as a blind, roller shutter or the like, comprising a roller tube inside which there are housed an electric motor and speed reduction gear which are mounted in a tubular housing fixed by one of its ends to a cheek intended to be fixed to a support, together with means for coupling the reduction gear to the roller tube, means for automatically stopping the motor when the blind is completely rolled up and means for automatically stopping the motor when the blind has reached a desired state of unrolling, the device further comprising means for detecting that the motor is blocked, causing the motor to be stopped in the event of such blockage being detected, and means for adjusting the stopping point of the motor corresponding to the desired state of unrolling.

PRIOR ART

Roller devices are known in which the motor is automatically stopped by a turns counting device consisting of a screw driven by the reduction gear and on which there is mounted a traveling nut prevented from rotating and actuating a switch at the end of a certain amount of movement along the screw, actuation of the switch corresponding to the desired stopping point. In some of these devices, two traveling nuts are provided each one moving along a screw and each one interacting with a switch corresponding respectively to the top stopping point and to the bottom stopping point for the blind (DE 28 49 512, FR 2 076 529). The stopping points are adjusted by manually rotating each of the screws. Another known device (FR 1 487 414) has just one traveling nut interacting with two switches themselves mounted on screws allowing them to be moved in order to adjust the top and bottom stopping points.

Despite the adjustment possibilities offered by these known roller devices, these do have the drawback that they do not take account of the dimensional variations in the roller element, which variations are due to wearing of the mechanical parts and to changes in the hygrometric conditions under which they run, the length of canvas blinds varying especially with the moisture content of the air. If the moisture content is low, the canvas extends and this extension, combined with structural alterations in the installation, has the result that changes in the top stopping positions of the roller element occur. In cases where several of these roller elements are arranged side by side along the facade of a building, for example, the elements are not completely rolled up in the stopping position, all the stopping points are different from one another, which is particularly unsightly. If the moisture content is great, then it is usual instead for these to be a reduction in length of the canvas, the consequence of this being mechanical stoppage by butting against the top part of the installation, before electrical stoppage. The drawback is that the motor remains powered, cycling in pace with the thermal cutout, if there is one, and that it is rapidly damaged. Furthermore, the stopping points are adjusted by means of a relatively complicated and delicate mechanical system.

It has been proposed to provide stoppage in the completely rolled up position by means of a switch actuated directly by the blind when it is completely rolled up (DE 1 763 272). Such a solution does, however, require the running of wires between the motor and the switch. In this device, the bottom stopping point is provided by a turns counter device consisting of a screw and of a traveling nut actuating a switch. No adjustment means is provided.

Roller devices are also known in which the roller element is stopped by detecting a drop in rate of movement of the rolling element (EP 0 533 625, EP 0 573 388). Such devices require detection means and relatively expensive processing electronics.

Furthermore, various devices are known which detect the braking or blocking of a motor by detecting an excess of current being drawn (JP 42 50 286, DE 42 44378), detecting a variation in speed (DE 44 01 463) or a drop in voltage on the auxiliary phase of an asynchronous motor (DE 43 12 987) or at the terminals of the phase-shift capacitor (EP 0 551 053).

SUMMARY OF THE INVENTION

The object of the invention is to produce a roller device comprising means for stopping the roller element in the top and bottom positions, means which are mechanically simple, robust and compact and which, under all circumstances, ensure complete rolling up of the rolling element, and uniform rolling up in the case of several roller elements arranged side by side.

The roller device according to the invention is a device which comprises, mounted in said tubular housing, a screw driven by said reduction gear and carrying a traveling nut prevented from rotating and at least one fixed non-adjustable stop and wherein said cheek is mounted so as to be able to rotate on said support, means being provided for immobilizing the cheek on its support, the motor being stopped when the roller element is completely rolled up, by detecting blockage of the motor brought about by the end of the roller element coming against a stop, the motor being stopped when the roller element has reached the desired state of unrolling, by detecting blockage of the motor brought about by the traveling nut coming against one of the stops, the corresponding stopping point being adjusted by manually rotating said cheek.

The means for immobilizing the cheek on its support may consist of a simple blocking screw. It is also possible to use a blocking means which at the same time can be used as a means for rotating the cheek, for example a screw mounted transversely in the cheek and interacting with helical toothing formed on the perimeter of a fixed cylindrical mounting piece about which the cheek can turn.

The bottom stopping point of the roller element is therefore adjusted by rotating the housing containing the motor and the screw and traveling nut device, that is to say by rotating the means normally used merely for preventing the traveling nut from rotating. As may be observed, this approach, combined with stopping in the top position by detecting that the motor is blocked makes it possible to obtain a particularly simple construction. The adjustment of the bottom stopping point will be described within the context of the description of one embodiment. Stopping the motor by detecting that it is blocked may be achieved by any means for detecting or analyzing a variation in an electrical parameter associated with the mechanical blockage of the rotor of the motor, and in particular by one of the devices described in the documents quoted above.

BRIEF DESCRIPTION OF THE DRAWINGS

The attached drawing represents, by way of example, one embodiment of the device according to the invention, together with two alternative forms thereof.

DESCRIPTION OF THE PREFERRED EMBODIMENT(S)

Figure 1:
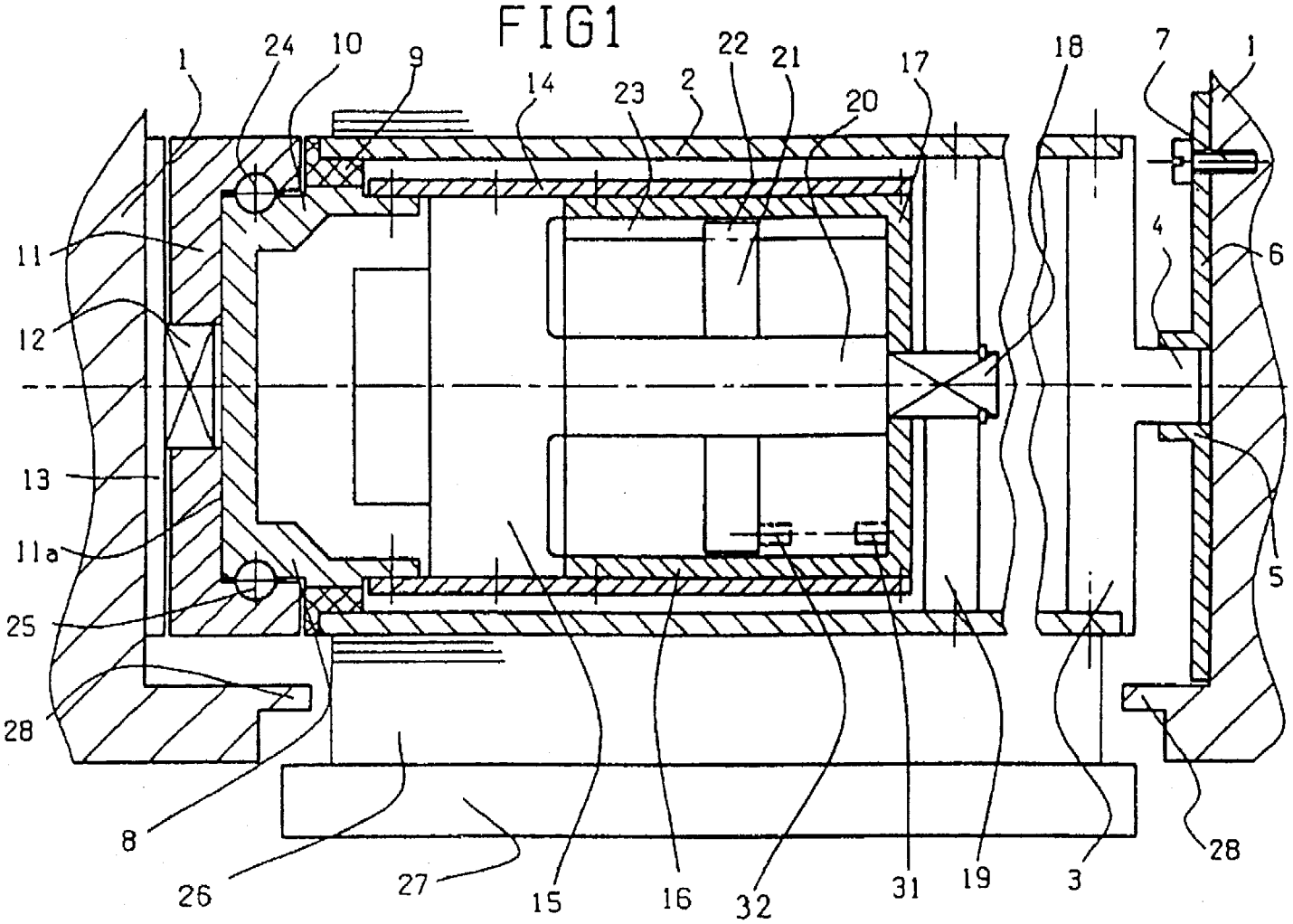
FIG. 1 is a partial view in axial section of a roller device.

The roller device represented in FIG. 1 is mounted in a casing 1 itself mounted, for example, in a window recess, not represented. It comprises a roller tube 2 closed at one of its ends by a cheek 3 fitted with a journal 4 turning in a bearing 5 formed in a plate 6 fixed to the casing by screws 7. The other end of the roller tube 2 is mounted so that it can rotate on a cylindrical bearing surface of a cheek 8 via a ring 9 with a low coefficient of friction fixed to the roller tube 2. The cheek 8 has a second cylindrical bearing surface 10 engaged in a cylindrical cutout 11*a* of a mounting piece 11 which has a square hole in which a square 12 of a support plate 13 fixed to the casing 1 is engaged. Fixed on the cheek 8 is a tubular housing 14 containing a reduction gear/motor unit 15 equipped with an electromagnetic brake which operates by absence of current or with some other braking means, for example an anti-return device as described, for example, in the patent FR 2 610 668 and a pot-shaped sleeve 16 fixed to the tubular housing 14 and the closed face 17 of which is situated at the end of the tubular housing 14. Passing axially through this sleeve 16 is the output shaft 18 of the reduction gear/motor unit to the end of which is fixed a disk 19 to which the roller tube 2 is fixed by screws. That part of the output shaft 18 which extends inside the sleeve 16 is threaded so as to form a screw 20 on which there is mounted a traveling nut 21 equipped with a tooth 22 engaged in a longitudinal slot 23 formed in the interior wall of the sleeve 16 and having the effect of preventing the traveling nut 21 from rotating while allowing it to move axially along the screw 20.

The cylindrical bearing surface 10 of the cheek 8 has helical peripheral toothing 24. Mounted transversely in the mounting piece 11 is a screw 25 immobilized axially in the mounting piece 11 and in engagement with the helical toothing 24 of the cheek 8. This screw 25 can be actuated from outside by means of a key or a screwdriver. Actuating the screw 25 has the effect of rotating the cheek 8, and with it the tubular housing 14, in the mounting piece 11.

A blind 26 fitted with a weighted bar 27 at its end is rolled up on the roller tube 2.

The installation of the roller device and the adjustment of the bottom stopping point are carried out as follows:

Before being mounted, the reduction gear/motor unit 15 is configured so that the traveling nut 21 is butting against the closed face 17 of the sleeve 16. In all instances the travelling nut 21 is brought into this position before the blind 26 is attached to the roller tube 2. The blind 26 is then attached to the roller tube 2 so that it is completely unrolled. The motor is then actuated so as to roll the blind 26 up. The traveling nut 21 therefore moves away from the closed face 17. When the blind 26 is completely rolled up, the weighted bar 27 butts against two bearing surfaces 28 of the casing 1. This has the effect of blocking the motor, which leads to an excess consumption of current which is detected by an electrical detection circuit with which the motor is equipped, this detection circuit cutting off the power to the motor. The blind is thus reliably rolled up perfectly and its weighted bar 27 does not protrude out of the casing.

The motor is then actuated in the other direction so as to unroll the blind 26. The traveling nut 21 moves toward the closed face 17 of the sleeve. When it comes into abutment against the closed face 17, the motor is blocked and the detection circuit again detects an excess consumption of current, which has the effect of cutting off the power supply to the motor as before. The blind therefore theoretically occupies the initial unrolled position. It is, however, possible to perfect the adjustment of the (bottom) stopping point corresponding to the desired position of unrolling by acting on the screw 25. The turning of the screw 25 when the motor is not powered and is blocked by its brake, has the effect of rotating the tubular housing 14 and with it the reduction gear/motor unit 15, the sleeve 16 and the roller tube 2 via the output shaft 18. By means of the screw 25 it is thus possible to roll up or to unroll the blind 26 slightly. Since the screw 25 cannot be driven by the torque exerted on the cheek 8, it simultaneously blocks this cheek.

Figure 2:
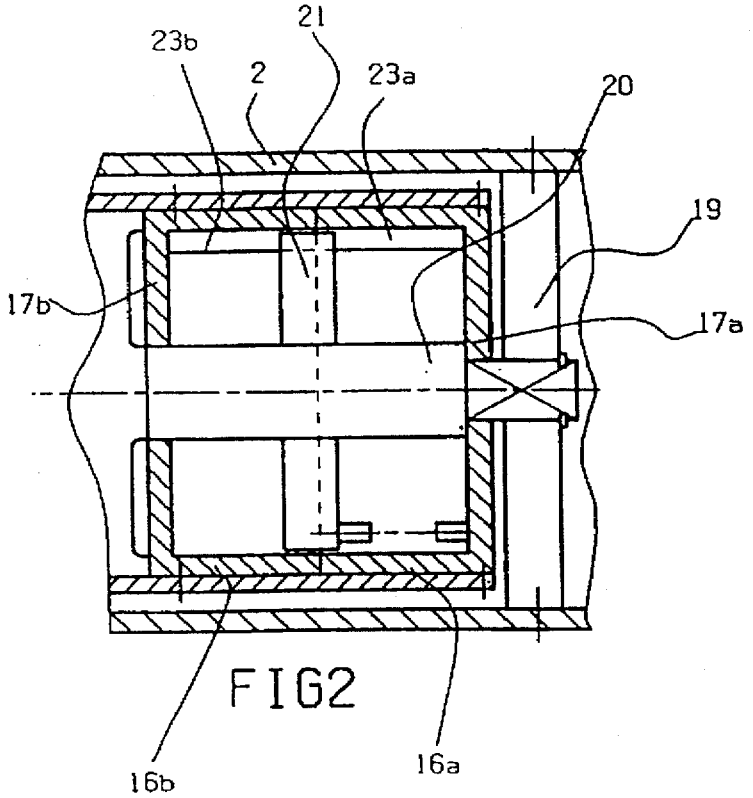
FIG. 2 is a partial view of a first alternative form.

The roller device represented in FIG. 1 is, in theory, designed to be mounted in a single and specified direction, the bottom point always being determined by the stop consisting of the closed face 17 of the sleeve, although the reduction gear itself can be used as a stop. However, if it is desired for the roller device to be able to be mounted without preference in one direction or in the other, the sleeve 16 will be replaced by two opposed pot-shaped sleeves 16*a* and 16*b* as represented in FIG. 2, it being possible for the traveling nut 21 to butt either against the closed face 17*a* of one of the sleeves or against the closed face 17*b* of the other sleeve.

Figure 3:
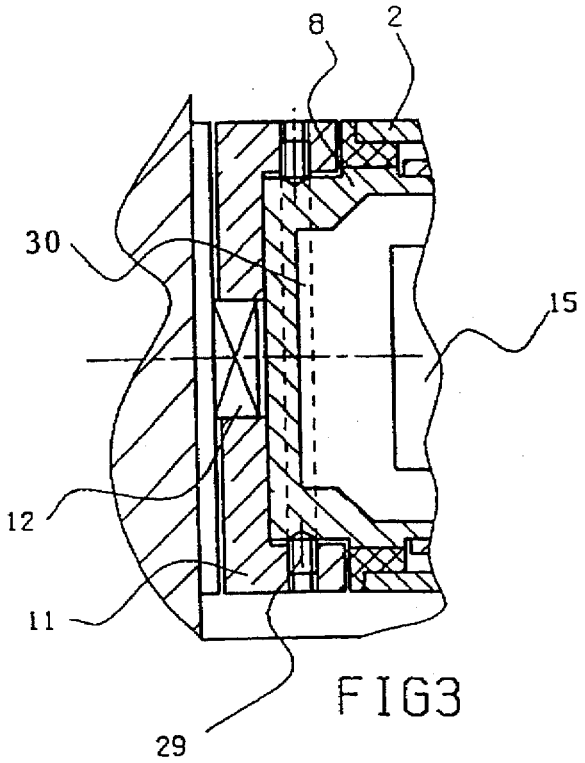
FIG. 3 is a partial view of a second alternative form.

The cheek 8 could be prevented from rotating by other means. In a simplified embodiment represented in FIG. 3, the fixed mounting piece 11 is equipped with one or two binding screws 29 which press radially in a groove 30 of the cheek 8. In this case, to perfect the adjustment of the bottom point, the roller tube is rotated directly by hand.

Instead of butting axially against the closed face of the sleeve 16, the traveling nut 21 is preferably equipped on its front face with a stub 30, as represented in chain line, intended to butt laterally against a stub 31 provided on the closed face of the sleeve 16. This embodiment makes it possible to obtain better accuracy of the stopping point.

We claim:

1. A device for rolling up a roll-up element such as a blind, roller shutter or the like, comprising a roller tube (2) inside which there are housed an electric motor and speed reduction gear (15) which are mounted in a tubular housing (14) fixed by one of its ends to a cheek intended to be fixed to a support (13), together with means (19) for coupling the reduction gear to the roller tube, means for automatically stopping the motor when the roll-up element (26) is completely rolled up and means for automatically stopping the motor when the roll-up element has reached a desired state of unrolling, the device further comprising means for detecting that the motor is blocked, causing the motor to be stopped in the event of such blockage being detected, and means for adjusting the stopping point of the motor corresponding to the desired state of unrolling, said device comprises, mounted in said tubular housing (14), a screw (20) driven by said reduction gear and carrying a traveling nut (21) prevented from rotating and at least one fixed non-adjustable stop (17;31) limiting the travel of the traveling nut in one of the directions in which it moves along the screw, and wherein said cheek (8) is mounted so as to be able to rotate on said support, means (24, 25; 29) being provided for immobilizing the cheek on its support, the motor being stopped when the roll-up element is completely rolled up, by detecting blockage of the motor brought about by the end (27) of the roll-up element coming against a stop (28), the motor being stopped when the blind has reached the desired state of unrolling, by detecting blockage of the motor brought about by the traveling nut (21) coming against the stop (17; 31), the corresponding stopping point being adjusted by manually rotating said cheek.

2. The device as claimed in claim 1, wherein said cheek (8) has a cylindrical bearing surface (10) by means of which the cheek is mounted so as to be able to rotate in a fixed mounting piece (11).

3. The device as claimed in claim 2, wherein the means for preventing the cheek (8) from rotating on its support consist of a screw (25) mounted transversely in said fixed mounting piece (11) and in engagement with peripheral helical toothing (24) of said cheek (8).

4. The device as claimed in claim 2, wherein the means for mobilizing the cheek (8) on its support consist of at least one screw (29) mounted in the fixed mounting piece (11) and butting against said cheek (8).

5. The device as claimed in claim 1, wherein the screw (20) carrying the traveling nut is mounted in a sleeve consisting of a cylindrical pot (16), the internal wall of which has a longitudinal profile (23) interacting with a mating profile (22) of the traveling nut in order to guide this nut and prevent it from rotating, the stop consisting of or being carried by the closed face (17) of the sleeve.

6. The device as claimed in claim 1, wherein the screw (20) carrying the traveling nut is mounted in a sleeve consisting of two opposed cylindrical pots (**16*a*, 16*b*), the interior walls of which have a longitudinal profile (23*a*, 23*b*) interacting with a mating profile of the traveling nut in order to guide this nut and prevent it from rotating, the closed faces (17*a*, 17*b***) of these pots constituting or carrying opposed stops.

7. The device as claimed in claim 1, wherein the screw (20) carrying the traveling nut at the same time constitutes the output shaft of the reduction gear and the shaft transmitting movement to the roller tube.

* * * * *